US005927950A

United States Patent [19]

Juvenal

[11] Patent Number: 5,927,950

[45] Date of Patent: Jul. 27, 1999

[54] DEVICE FOR CONTROLLING THE SUPPLY OF WATER (OR OTHER LIQUID) BY A PUMP AND FOR PROTECTING THE SAME IN THE EVENT OF DRY RUNNING

[75] Inventor: Quispe Lapa Juvenal, Firenze, Italy

[73] Assignee: LAPA Services S.r.l., Prato, Italy

[21] Appl. No.: 08/846,835

[22] Filed: May 1, 1997

[30] Foreign Application Priority Data

May 3, 1996 [IT] Italy ..... FI/96/A/000102

[51] Int. Cl.[6] ..... F04B 49/03

[52] U.S. Cl. ..... 417/38; 417/43; 417/44.9

[58] Field of Search ..... 417/38, 43, 39, 417/80, 12, 44; 137/568; 200/81.9

[56] References Cited

U.S. PATENT DOCUMENTS

| | | | |
|---|---|---|---|
| 790,246 | 5/1905 | Atzberger | 417/39 |
| 818,525 | 4/1906 | Danke | 417/39 |
| 3,150,684 | 9/1964 | Guinard et al. | 137/568 |
| 5,190,433 | 3/1993 | Valdes | 417/38 |
| 5,259,733 | 11/1993 | Gigliotti et al. | 417/38 |
| 5,509,787 | 4/1996 | Valdes | 417/38 |

FOREIGN PATENT DOCUMENTS

| | | |
|---|---|---|
| 0 219 360 | 7/1986 | European Pat. Off. . |
| 0 321 376 | 12/1988 | European Pat. Off. . |

*Primary Examiner*—Charles G. Freay
*Assistant Examiner*—Robert Z. Evora
*Attorney, Agent, or Firm*—McGlew and Tuttle, P.C.

[57] ABSTRACT

The device comprises: a flowstat 16 with a slider 16B with a built-in magnet 22 designed to interfere with a proximity-operated electric switch 20A; a variable-volume chamber 1 with a flexible wall 9 and spring means 28 that tend to reduce its volume; and a slider 26 combined with said flexible wall 9 and comprising a cam profile 30 acting on the movable slider 16B of the flowstat in the event of a drop in pressure in said chamber 1, in order to displace said slider 16B in the same direction in which the slider is displaced by the flow that passes through the flowstat; by this means the pump is actuated to restore the pressure in said chamber 1; whereas when the pressure in said chamber 1 drops further, owing to a lack of supply of liquid to the pump, the cam profile 30 ceases to act on the movable slider 16B and the pump stops.

9 Claims, 7 Drawing Sheets

DEVICE FOR CONTROLLING THE SUPPLY OF WATER (OR OTHER LIQUID) BY A PUMP AND FOR PROTECTING THE SAME IN THE EVENT OF DRY RUNNING

FIELD OF THE INVENTION

The invention relates to a device for controlling a pump supplying water (or other liquid) towards a point of use and for protecting the pump—by preventing it from operating—in the event that there is no supply of water (or other liquid) to the pump. Known forms of devices of this type are complex, expensive and not especially reliable, particularly because of their use of several electrical mechanisms, the functioning of which must be guaranteed in order to achieve efficient results.

BACKGROUND OF THE INVENTION

For example, EP 0219360 and U.S. Pat. No. 5,259,733 use two electrical switches operated by two magnets, the fields of action of which, when brought together, disturb the functioning of the machines. EP 0321376 uses an electric switch actuated by two magnets, which does away with one switch but still requires two magnetic fields, also brought together. The present device by contrast attains a high degree of simplicity, with the result that, it is much more reliable and inexpensive; also, other disadvantages of the devices of the prior art are eliminated with the present device, which also offers other advantages that will become clear in the following text.

SUMMARY OF THE INVENTION

The device according to the invention is of the type that comprises: a flowstat with a slider whose movements are dependent upon the flow of liquid (against a contrary action produced by gravity or in some other way), linked to an electronic circuit comprising a proximity-operated electric switch having an actuator for opening and closing said circuit; a variable-volume chamber formed in the path of the liquid between a check valve and the flowstat, and comprising a flexible wall combined with spring means or some equivalent, that tend to reduce its volume; and means for starting the pump promptly when the pressure in the chamber drops below a certain threshold. According to the invention, said device is characterized in that it comprises a single electric switch with only one magnet and a cam profile inseparably connected to said flexible wall and acting on the movable slider of the flowstat, in order to displace it in the same direction in which said slider is displaced by the flow passing through said flowstat. By this means the pump is turned on until the maximum pressure generated by the pump itself in said chamber is restored, when the lowering of the pressure is due to a small leak downstream of the device; whereas when, owing to a lack of supply of water (or other liquid) to the pump, the pressure in said chamber continues to fall, said cam profile moves further and ceases to act on said movable slider and the pump is stopped.

In practice said cam profile may have two opposite slopes on opposite sides of a cusp; the slope that acts first on the movable slider of the flowstat displaces said slider and starts the pump, whereas, in the absence of supply to the pump, the cusp moves past it, causing the flowstat to return to its original position, thereby turning the pump off.

The device may also include a manually controlled resetting switch in parallel with the electric actuator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
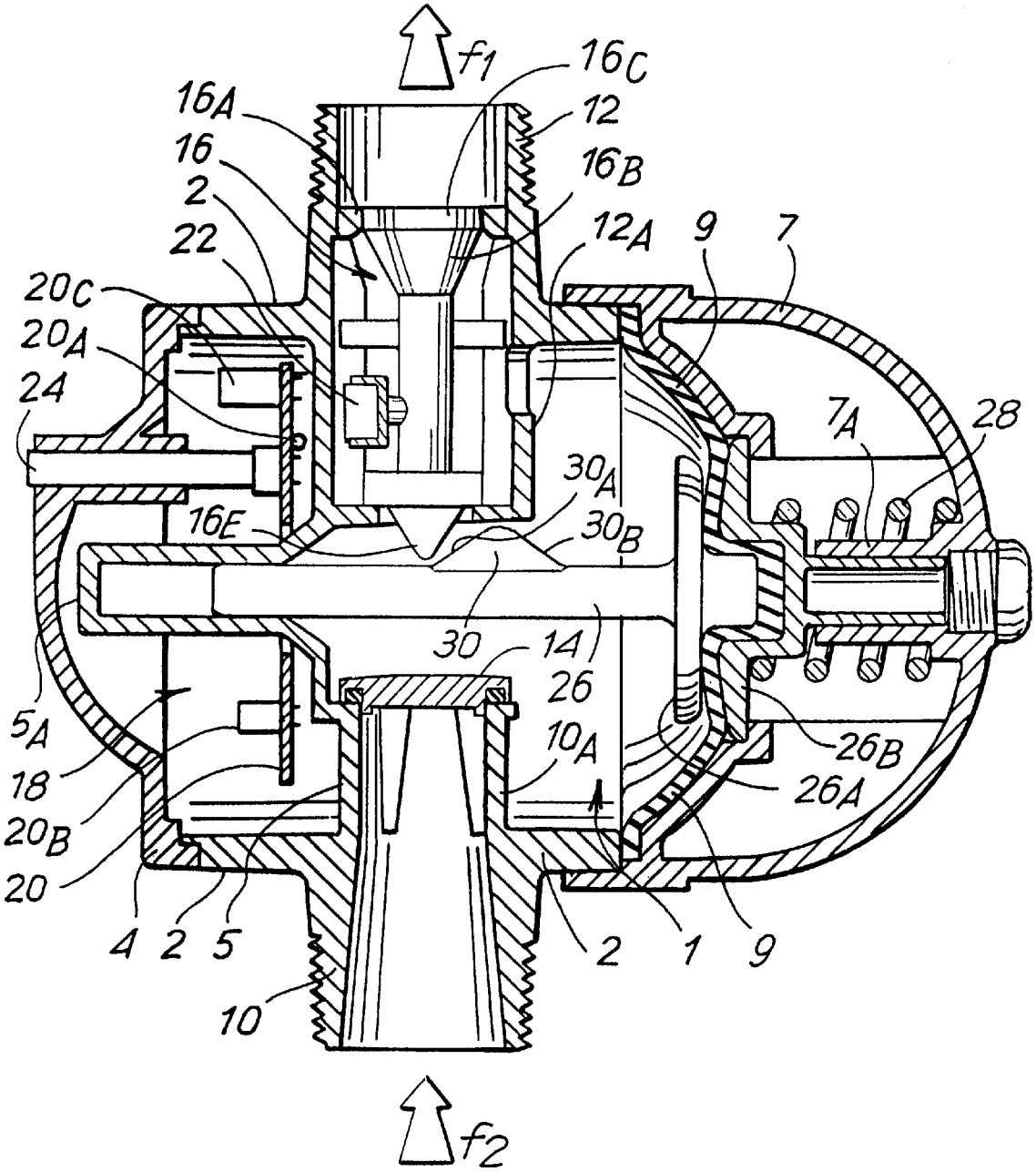
FIG. 1 is a longitudinal sectional view of the device in the condition in which the tap is closed and the pump is off, the device being at pressure and no flow taking place.
Figure 6:
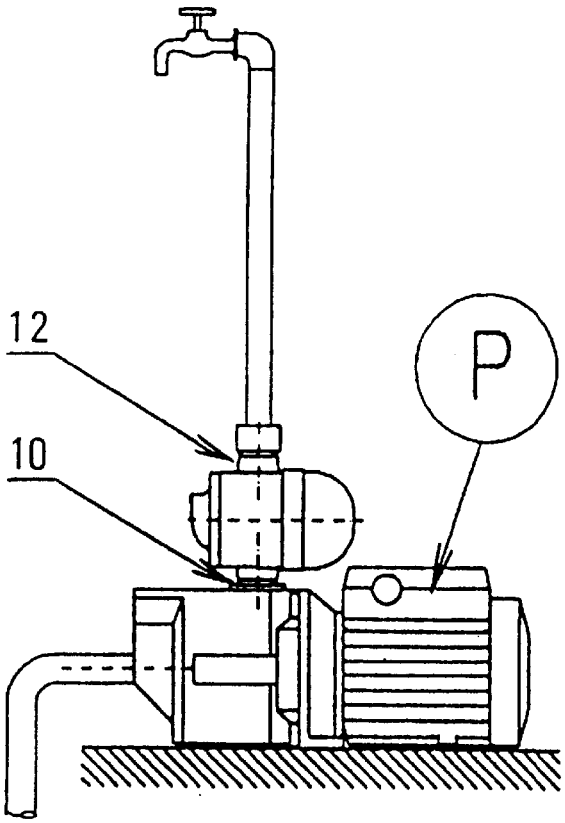
FIG. 6 shows one way in which the device can be installed.
Figure 7:
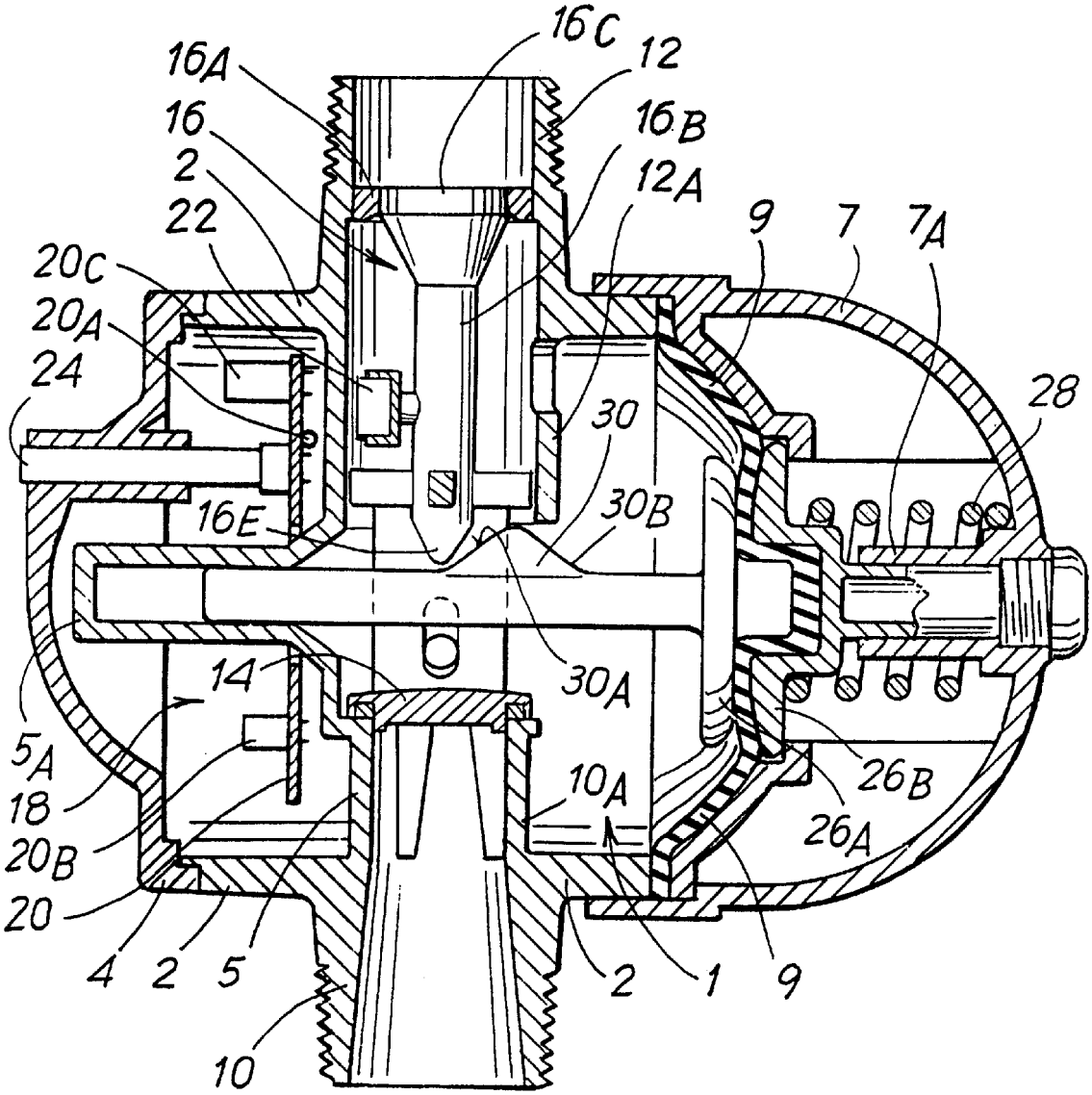
FIG. 7 is a view of an alternate embodiment in the same position as in FIG. 1.
Figure 9:
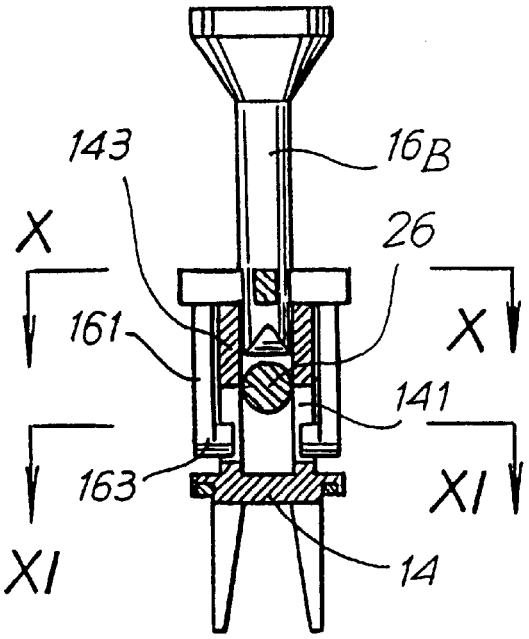
FIG. 9 shows an partial cross-section side view of the flowstat and the check valve connected to each other by a link between pins and slots along the line IX—IX of FIG. 8.
Figure 8:
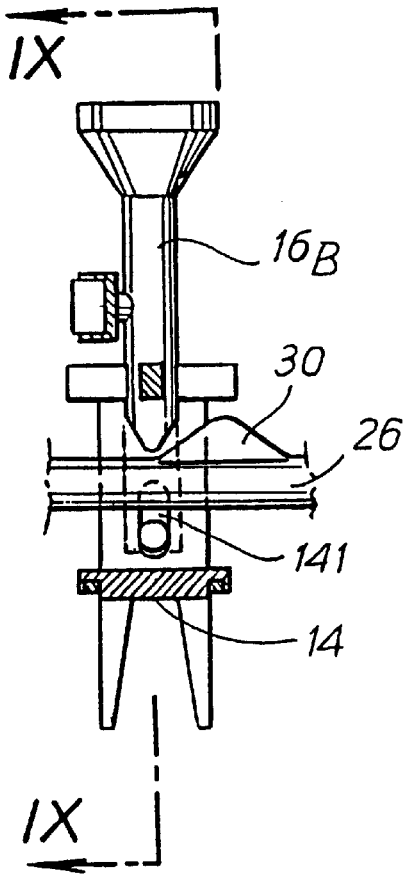
FIG. 8 shows an alternative embodiment with the flowstat and the check valve connected to each other by a link between pins and slots.
Figure 10:
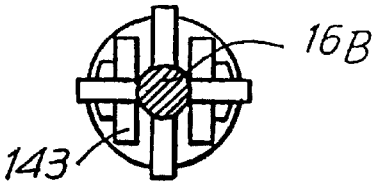
FIG. 10 shows an cross-section top view of the flowstat and the check valve connection along the line X—X of FIG. 9.
Figure 11:
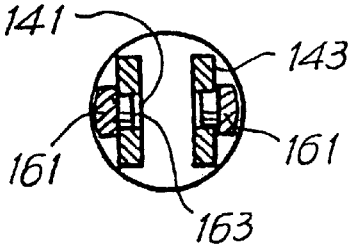
FIG. 11 shows an cross-section top view of the link between pins and slots and the check valve connection along the line XI—XI of FIG. 9.

In accordance with the attached drawing, 1 is a variable-volume chamber defined in part by a cylindrical wall 2 with a closed end 5, and by a cap 7 that circumferentially grips a flexible wall 9. Formed in the cylindrical wall 2 are a supply stub 10 and a delivery stub 12. The stub 10 is connected to the electric supply pump P, while the delivery stub 12 is connected to the point of use (FIGS. 1 and 6). The supply stub 10 is combined with an extension 10A that forms a seating for a check valve 14, the latter being mushroom-shaped with a seal operating on the flat seating. The delivery stub 12 is combined with an extension 12A that forms a slide seating for a movable slider 16B with a head 16C interacting with the seating 16A and with an end nose 16E inside the chamber; the whole of which constitutes a flowstat bearing the general reference 16.

The two extensions 10A and 12A complete the definition of the variable-volume chamber together with the closed end 5. The closed end 5 together with the wall 2 and a cover 4 defines a housing 18 suitable for, containing an electronic circuit 20, of which a proximity switch 20A is part. The switch can be activated by a magnet 22 built into the movable slider 16B of the flowstat; in moving from a position of proximity shown in FIG. 1 to a remote position shown in FIG. 2 (and vice versa). The magnet 22 triggers a start (and stop) signal to the pump through the proximity switch 20A (indicated diagrammatically also in FIG. 5) connected to a delay device 20B for delaying the opening of the activation circuit of the electric pump P. Also visible in the drawing is a manual control switch 24 mounted in parallel with the actuator 20C for starting the pump after a stoppage caused by the absence of water or other supply liquid, as will be explained later.

The flexible wall 9 is gripped centrally between a front shaped expansion 26A and a rear shaped expansion 26B that are part of a movable slider 26 guided by a rear slide seating 7A formed in the cap 7 and by a front slide seating 5A formed in the closed end 5, which divides the variable-volume chamber 1 from the housing 18 of the electronic circuit 20. The movable slider 26 is under pressure from a spring 28, which acts on the expansion 26B and reacts on the inside of the cap 7, in such a way that the flexible wall 9 is acted on in a direction tending to reduce the volume of the variable-volume chamber 1.

Figure 2:
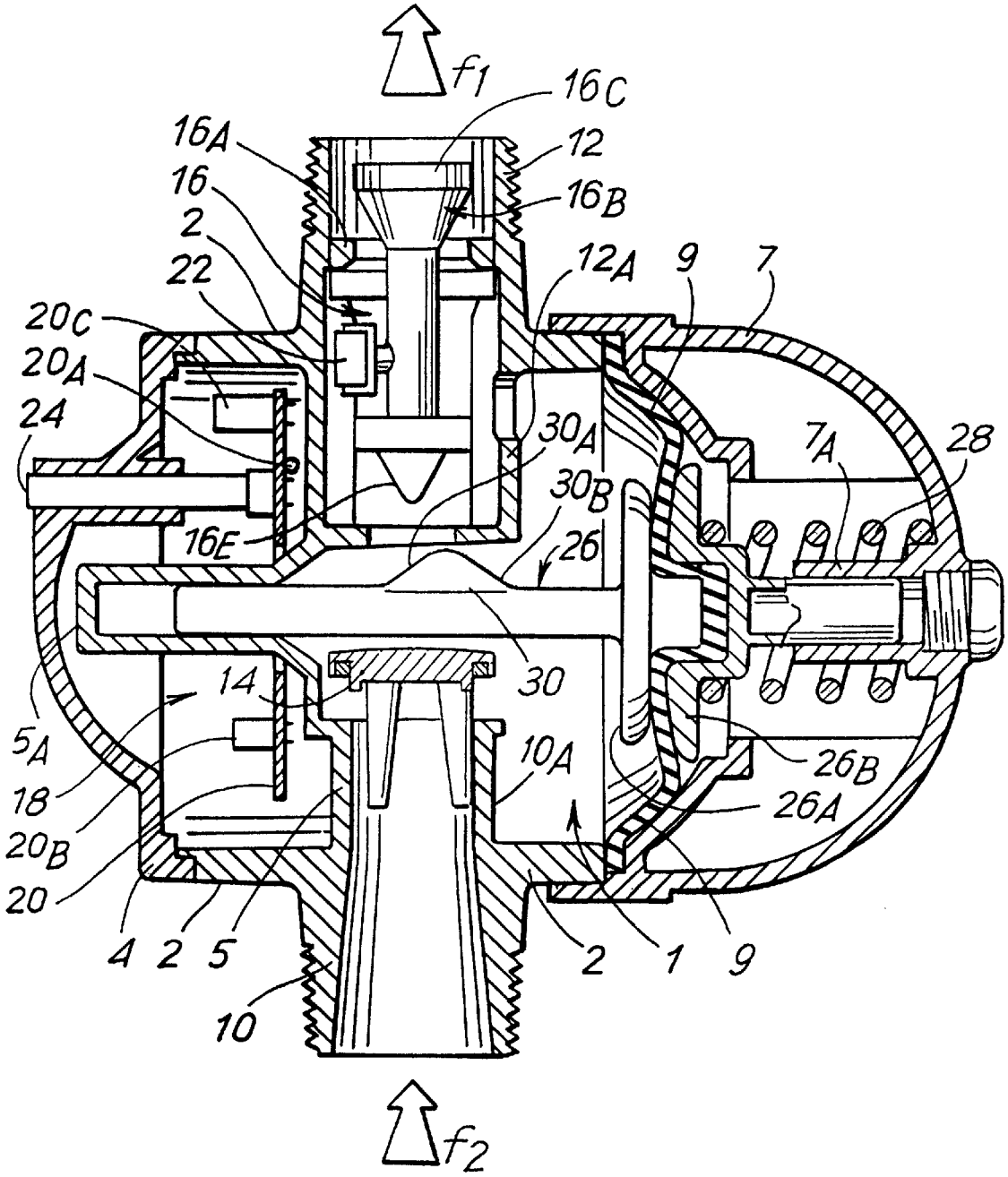
FIG. 2 is a view of the condition when the tap is open and the pump running, the device being at pressure with low taking place.
Figure 3:
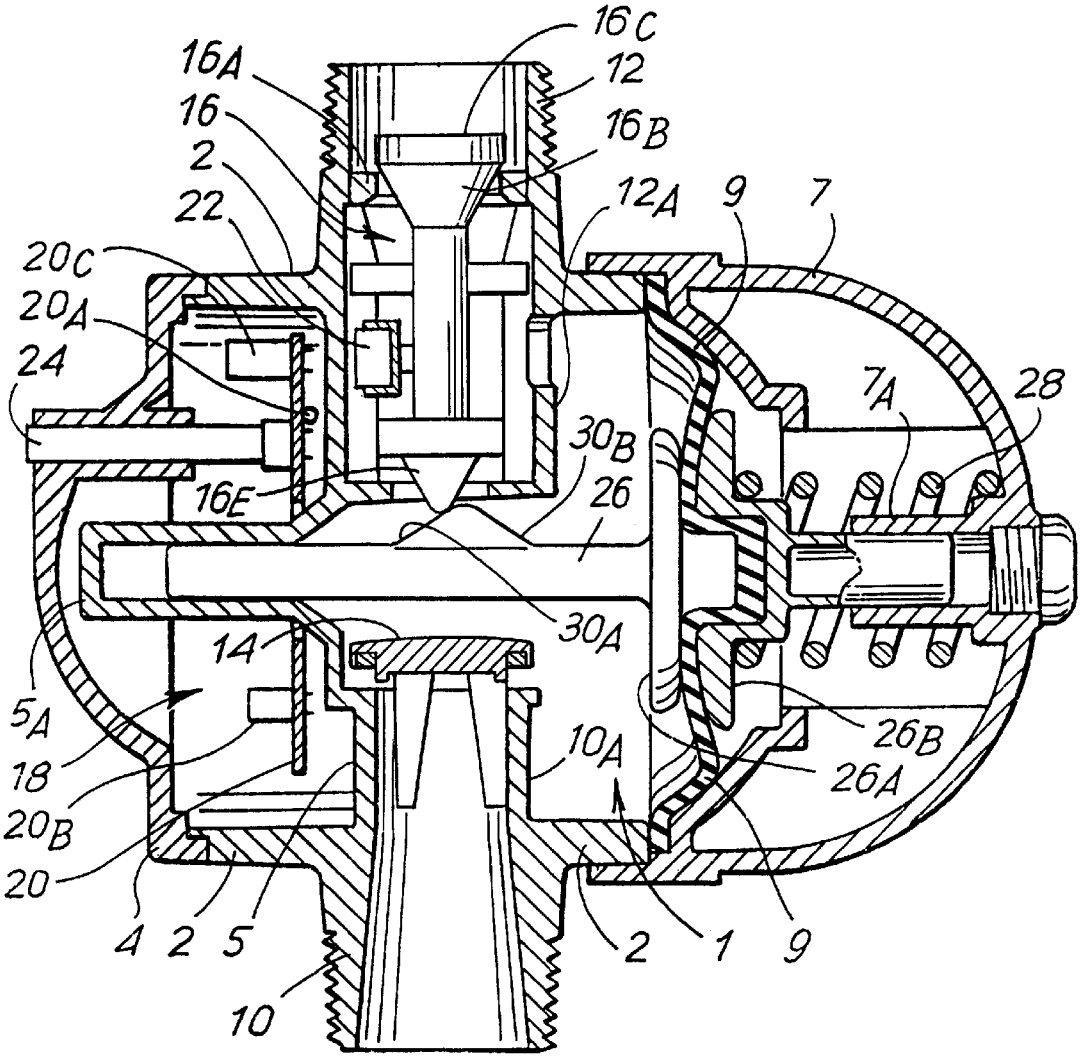
FIG. 3 is a view of the condition in which the pressure, is being restored when small leaks are present.

Inside the variable-volume chamber 1 the stem part of the slider 26 has a cam profile 30 pointing in the direction of the delivery stub 12, with two opposite slopes (front 30A and rear 30B); the cam profile 30 with its two slopes interferes with the nose end 16E of the movable slider 16B of the flowstat 16. As it slides along with its movable slider 26, the cam profile 30 can displace, that is, lift, the movable slider 16B from the active position of the magnet 22 on the proximity switch 20A (FIG. 1) to a position, in conditions of normal operation, remote from the switch 20A (FIG. 3). The displacement of the movable slider 16B of the flowstat 16 from the down position in which the magnet 22 is active on the proximity switch 20A to a position of the movable slider in which the magnet 22 ceases to act on the proximity switch, is however determined by the flow between the supply stub 10 and the delivery stub 12 whenever this flow is above a certain rate (FIG. 2). The movable slider 16B of the flowstat is capable of movements in a vertical direction, or at any rate in a direction with a large vertical component, within the seat, but this is not to say that a different opposing action on the movable slider 16B is not also possible, for example by means of a spring.

The manner in which the device works is as follows.

When there is no request for a supply of water to the point of use and no leak downstream of the stub 12, the conditions are those of FIG. 1; the working pressure in the variable-volume chamber 1 remains the maximum pressure generated by the pump, so the flexible wall 9 is pressed against the cap 7, the movable slider 16B of the flowstat is down with its nose 16E towards the movable slider 26 and to the left of the cam profile 30 when viewing FIG. 1, and the check valve 14 is closed by a reverse bias means such as gravity or some other opposing action. The pressure in the chamber 1 does not fall as there are no leaks.

When the tap at the point of use is turned on the movable slider 16B immediately lifts from its position as shown in FIG. 1 to that shown in FIG. 2 as a flow is sent up in the direction of arrow f1 from the chamber 1 towards the point of use; and the magnet 22 moves away from its position of influence on the proximity switch 20A, causing the proximity sensor to trigger the immediate starting of the pump P, in such a way as to make the pressure drop in the variable-volume chamber 1 very small and almost negligible. This pressure is maintained by the action of the spring 28 tending to push on the flexible wall 9 and reduce the volume of the chamber 1. As soon as the pump starts up, the check valve 14 rises and the working pressure is restored in the chamber 1, which latter increases its own volume by pushing back the flexible wall 9 towards the cap 7 against the action of the opposing spring 28; the movable slider 16B on the flowstat stays up because of the flow created by the pump P an the direction of arrows f2 and f1 as shown in FIG. 2; and the slider 26 of the flexible wall 9 reverts to the condition shown in FIG. 1. When the liquid ceases to be drawn from the point of use and the tap downstream of the stub 12 is turned off, the slider 16B drops back once again into the position shown in FIG. 1, switching off the pump and leaving the device ready for the next use; the pressure in the chamber 1 remains the maximum pressure generated by the pump.

It should be noted that during normal operation as described above, the cam profile 30 is never active, the slope 30A never reaching the nose 16E because the movable slider 16B moves away from the slider 26 before such contact can occur.

When, during conditions of closure of the flow (FIG. 1), a leak occurs downstream of the stub 12 towards the point of use, the movable slider 16B of the flowstat 16 does not move because the amount of flow induced by the leak is too small to displace it and therefore to start up the pump. However, in this case, because the pressure in the chamber 1 will slowly tend to decline and the flexible wall 9 will tend to displace under the action of the spring 28, the slope 30A of the cam profile 30 will eventually lift the nose 16E and hence the slider 16B; the magnet 22 is therefore gradually moved away from the proximity switch 20A until eventually the pump is started as the position shown in FIG. 3 is reached; the pump then restores the pressure in the variable-volume chamber 1, and the flexible wall 9 moves back against the seat formed by the cap 7, placing the spring 28 back under compression. The cycle repeats itself intermittently at a frequency that depends on the size of the leak and hence how fast the pressure in the chamber 1 is falling; each cycle restores the pressure in the chamber 1 and moves the flexible wall 9 back against the cap.

Figure 4:
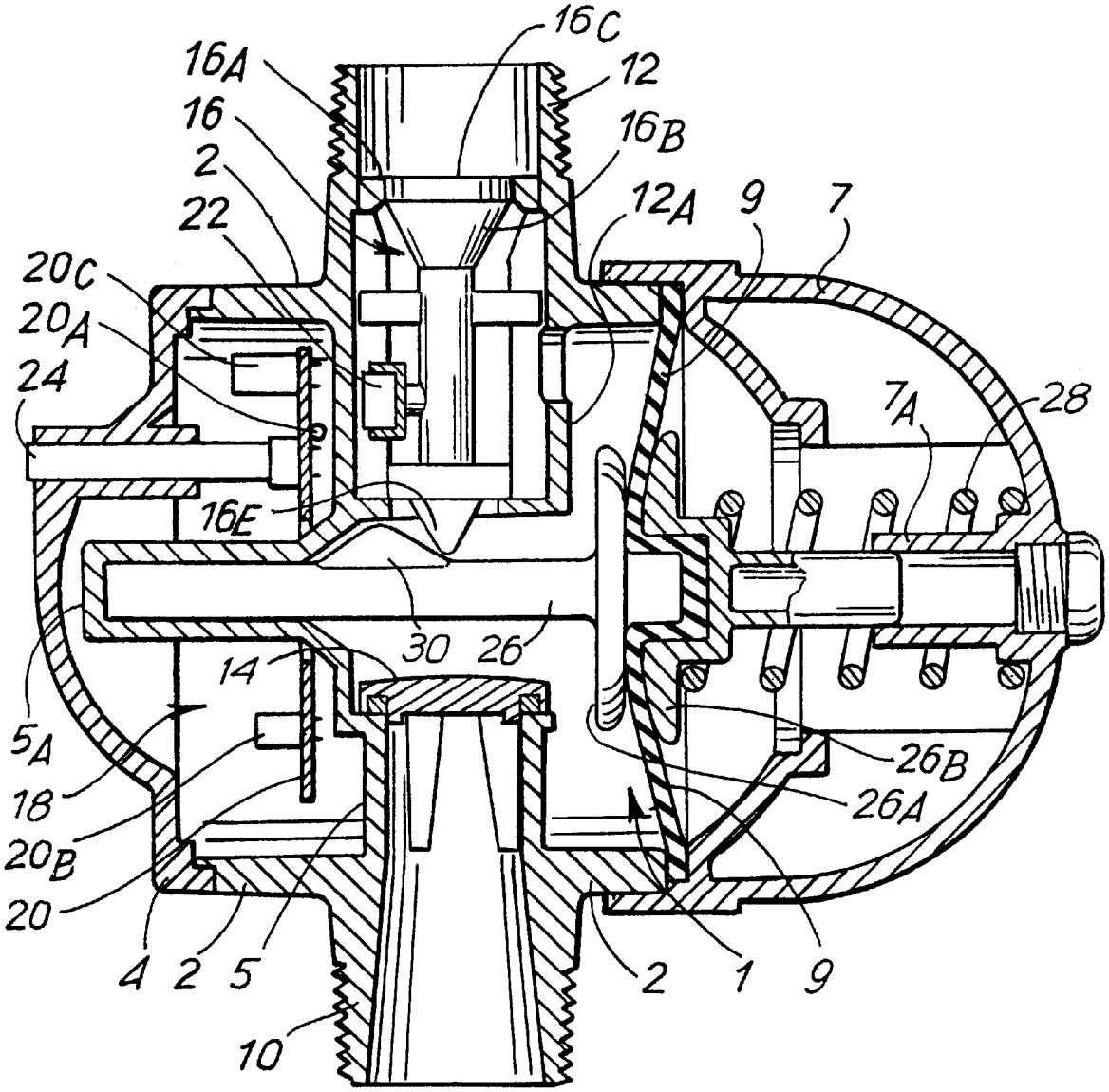
FIG. 4 shows the condition in which the tap is open and the pump off because of an absence of flow and an absence of pressure, caused by the non-supply of water or other liquid to the pump.

When, in a situation in which flow is required through the point of use or a leak is present downstream of the stub 12, there is no supply of water or other liquid to the pump P when the latter is activated, and therefore the pump P fails to supply liquid under pressure to the chamber 1, this chamber 1 will tend to shrink further in volume beyond the conditions already described, to the point where—again because of the residual compression of the spring 28—it pushes the cam profile 30 with its rear slope 30B all the way past the nose 16E, in other words to the point where the cam profile 30 has traversed from the right-hand side to the left-hand side of the nose 16E (when viewing the drawing), ending up in the condition shown in FIG. 4. In this condition the movable slider 16B of the flowstat 16 drops back down and stops the pump promptly, thus protecting the pump from any damage caused by the lack of supply. The condition shown in FIG. 4, caused by the lack of water (or other liquid) in the supply, continues until there is manual intervention, and only when the water supply to the pump has been restored. Basically, then, normal operating conditions can only be restored by acting manually on the switch 24, thereby starting the pump P deliberately, and only in the presence of a supply of water to the pump.

Figure 5:
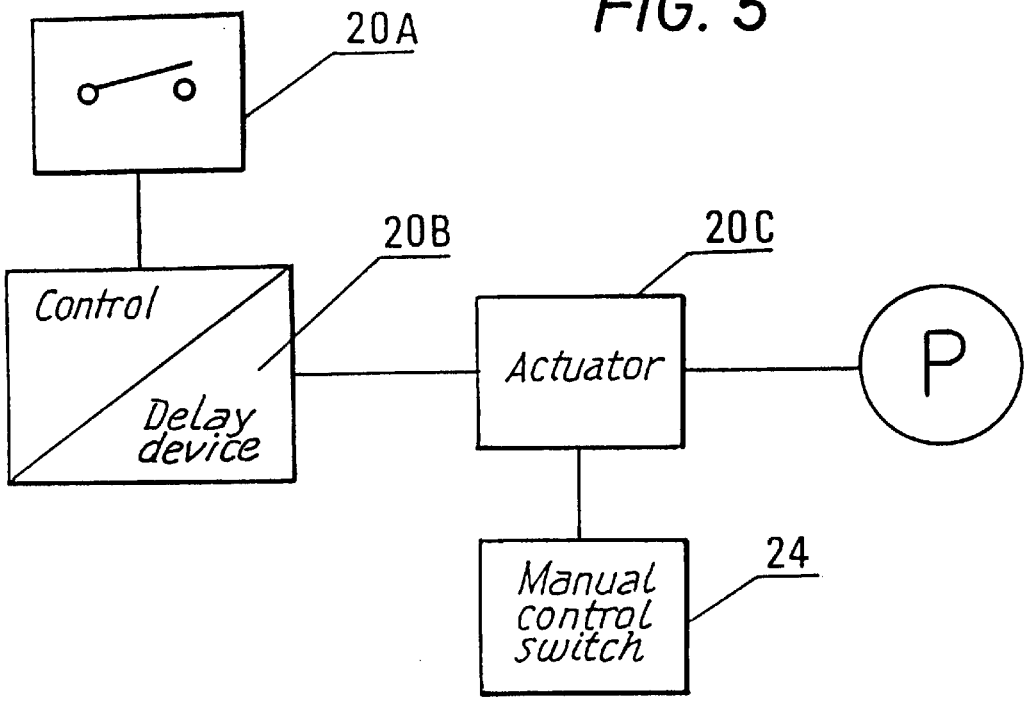
FIG. 5 is a view of a highly simplified electrical diagram that forms an integral part of the pump control device.

The proximity switch 20A is accompanied by the delay device 20B as shown in the diagram in FIG. 5, in order to keep the pump running for a short time following changes in the condition of the flowstat, so that the performance of the device is preserved without, however, at any time compromising the integrity of the pump.

It is possible to fine-tune the pressure in the variable-volume chamber 1 at which the pump intervenes, in order for the cam profile 30 to work efficiently, by increasing or reducing the precompression and hence increasing or reducing the thrust of the spring 28 on the flexible wall 9. This can also be done by interposing suitable spaces between the bearing parts of the spring 28, i.e. on the expansion 26B and/or on the inside of the cap 7.

In an alternative embodiment shown in FIGS. 7 to 11, in which the same references indicate identical or equivalent parts, a connection is provided between the check valve 14 and the slider 16B of the flowstat. The connection may be rigid, or, preferably, a small amount of play is provided between these two parts 16B and 14, as in the drawing. The slider 16B possesses two projections 161 with opposing pins 163 pointing towards each other, snapped into position and able to slide a short distance in two vertical slots 141 formed in two projections 143 from the head of the valve 14. Between the two projections runs the stem of the slider 26, which carries the cusp-like cam 30. With this arrangement the slider 16B of the flowstat in part made heavier by the mass of the valve 14, which harms the effect of ensuring that the flowstat can still move even in the presence of impurities which might otherwise limit its free travel. The flowstat 16 is still free to rise even before the valve 14 rises.

It will be understood that the drawing shows only an example given purely by way of a practical demonstration of the invention, which latter can be varied as regards shapes and arrangements without however departing from the scope of the concept underlying said invention. The presence of any reference numerals in the appended claims is for the purpose of facilitating the reading of the claims with reference to the description and drawing, and does not limit the scope of protection represented by the claims.

I claim:

1. Device for controlling a supply of a liquid by a pump, the device comprising:

a flowstat with a slider whose movement responds to a flow of the liquid sufficient to overcome the weight of the flowstat and electrically connected to an electronic circuit comprising:

a proximity-operated electric switch having a delay device for delaying the opening of the circuit; a variable-volume chamber including a flexible wall and a spring means for reducing a volume of said chamber, said chamber being situated between a check valve and the flowstat; a pressure starting means for starting the pump when the pressure in the chamber drops below a predetermined pressure level, said pressure starting means including a cam profile permanently connected to said flexible wall and contacting said slider of the flowstat during a lack of supply of the liquid to displace said slider in a run direction in which said slider is displaced by the flowpassing through the flowstat, displacement of said slider generating a run signal turning the pump on until the medium pressure generated by the pump in said chamber is restored, and displacement of said slider in said run direction ceasing and stopping the pump when the pressure in said chamber is below another predetermined pressure level.

2. Device according to claim 1 wherein said cam profile has a pair of opposite slopes on opposite sides of a cusp, the first slope first contacts said movable slider to displace the movable slider of the flowstat and start the pump, whereas, in an absence of supply from the pump, the cusp moves past said slider to return the slider to a position turning the pump off.

3. Device according to claim 1, wherein the movable slider of the flowstat and the check valve are coaxial and connected to each other by a link between pins and slots.

4. A device in accordance with claim 3, wherein:

said link provides play between said pins and said slots.

5. A device for controlling a fluid supply, the device comprising:

a housing having an input for receiving the fluid and an output for discharging the fluid;

a flowstat positioned in said output of said housing, said flowstat including a slider movable between first and second positions, said slider being biased toward said first position by the fluid flowing through said output, said flowstat including a reverse bias means for biasing said slider toward said second position, said flowstat including flow switch means for generating a run signal when said slider is in said first position;

pressure sensor means in said housing for moving mechanically said slider from said second position to said first position when a pressure of the fluid in said housing is below a predetermined value.

6. A device in accordance with claim 5, wherein:

said pressure sensor means allows said slider to move from said first position to said second position when said pressure of the fluid is below another predetermined value.

7. A device in accordance with claim 6, wherein:

said another predetermined value is below said predetermined value.

8. A device in accordance with claim 5, wherein:

said pressure sensor means includes a cam profile that moves in response to said pressure of the fluid in said housing, movement of said cam profile causing said cam profile to contact said slider and move said slider.

9. A device in accordance with claim 8, wherein:

said cam profile includes a first surface contacting said slider as said pressure is lowered below said predetermined value, said cam profile includes a second surface which allows said slider to move from said first position to said second position when said pressure of the fluid is below another predetermined value.

* * * * *

UNITED STATES PATENT AND TRADEMARK OFFICE

CERTIFICATE OF CORRECTION

PATENT NO. : 5,927,950

DATED : July 27, 1999

INVENTOR(S) : Quispe Lapa Juvenal

It is certified that error appears in the above-indentified patent and that said Letters Patent is hereby corrected as shown below:

Title page, item 56:

FOREIGN PATENT OR PUBLISHED FOREIGN PATENT APPLICATION

| | | DOCUMENT NUMBER | PUBLICATION DATE | COUNTRY OR PATENT OFFICE | CLASS | SUBCLASS | TRANSLATION YES | TRANSLATION NO |
|---|---|---|---|---|---|---|---|---|
| | EP | 0 3 2 1 3 7 6 A2 | 12/1988 | EPO | | | | |

should read:

FOREIGN PATENT OR PUBLISHED FOREIGN PATENT APPLICATION

| | | DOCUMENT NUMBER | PUBLICATION DATE | COUNTRY OR PATENT OFFICE | CLASS | SUBCLASS | TRANSLATION YES | TRANSLATION NO |
|---|---|---|---|---|---|---|---|---|
| | EP | 0 3 2 1 3 7 6 A2 | 06/21/1989 | EPO | | | | |

OTHER PRIOR ART(Including Author, Title, Date, Pertinent Pages, Etc.)

| |
|---|
| Tadakuma Mutsumi, September 13, 1982, AUTOMATIC OPERATING DEVICE FOR PUMP, Patent Abstract of Japan, Vol. 006 |
| Nakanishi Teruo, November 17, 1983, AUTOMATIC OPERATING APPARATUS FOR PUMP, Patent Abstract of Japan, Vol. 008 |

Signed and Sealed this

Twenty-sixth Day of October, 1999

*Attest:*

Q. TODD DICKINSON

*Attesting Officer*

*Acting Commissioner of Patents and Trademarks*